US009243545B2

(12) United States Patent
Quix

(10) Patent No.: US 9,243,545 B2
(45) Date of Patent: Jan. 26, 2016

(54) LIQUID-COOLED INTERNAL COMBUSTION ENGINE WITH LIQUID-COOLED CYLINDER HEAD AND WITH LIQUID-COOLED CYLINDER BLOCK

(71) Applicant: Ford Global Technologies, LLC, Dearborn, MI (US)

(72) Inventor: Hans Guenter Quix, Herzogenrath (DE)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 14/139,083

(22) Filed: Dec. 23, 2013

(65) Prior Publication Data

US 2014/0196674 A1 Jul. 17, 2014

(30) Foreign Application Priority Data

Jan. 11, 2013 (DE) ..... 10 2013 200 297

(51) Int. Cl.

| | |
|---|---|
| ***F01P 7/14*** | (2006.01) |
| ***F02F 1/40*** | (2006.01) |
| ***F01P 3/02*** | (2006.01) |

(52) U.S. Cl.

CPC ... *F01P 7/14* (2013.01); *F01P 3/02* (2013.01); *F02F 1/40* (2013.01); *F01P 2003/027* (2013.01); *F01P 2060/08* (2013.01); *F01P 2060/16* (2013.01)

(58) Field of Classification Search

CPC ..... F01P 7/14; F01P 3/02; F01P 2003/027; F01P 2003/028; F01P 7/165; F01P 2007/146; F01P 2060/08; F02F 1/10; F02F 1/14; F02F 1/40; F02F 1/36

USPC ..... 123/41.09, 41.44, 41.29, 41.82 R; 700/299, 300; 237/12.3 B

See application file for complete search history.

(56) References Cited

U.S. PATENT DOCUMENTS

| | | | | |
|---|---|---|---|---|
| 4,423,705 | A | 1/1984 | Morita et al. | |
| 4,605,163 | A * | 8/1986 | Hayashi | 237/2 A |
| 5,894,834 | A * | 4/1999 | Kim | 123/552 |
| 6,595,164 | B2 * | 7/2003 | Kunze et al. | 123/41.1 |
| 6,615,772 | B2 * | 9/2003 | Ichinose et al. | 123/41.14 |
| 6,688,262 | B2 * | 2/2004 | Murakami et al. | 123/41.1 |
| 6,895,904 | B2 * | 5/2005 | Kobayashi et al. | 123/41.14 |
| 6,955,141 | B2 * | 10/2005 | Santanam et al. | 123/41.08 |
| 7,647,900 | B2 * | 1/2010 | Hayashi et al. | 123/41.72 |
| 8,061,309 | B2 * | 11/2011 | Lenz et al. | 123/41.29 |

(Continued)

FOREIGN PATENT DOCUMENTS

| | | | | |
|---|---|---|---|---|
| EP | 2309114 A1 | 4/2011 | | |
| GB | 2245703 A * | 1/1992 | | F01P 3/02 |
| WO | 2008029058 A2 | 3/2008 | | |

*Primary Examiner* — Lindsay Low
*Assistant Examiner* — Grant Moubry
(74) *Attorney, Agent, or Firm* — Julia Voutyras; Alleman Hall McCoy Russell & Tuttle LLP

(57) ABSTRACT

One approach to provide engine cooling for an internal combustion engine includes pumping coolant from a pump output, in parallel, directly to a block and a head upper coolant jacket; flowing coolant from the block directly to a head lower coolant jacket; discharging coolant from the upper and lower jackets only to a control block; and selectively directing cooling from the control block to each of: a cabin heater; radiator bypass line; and the radiator. In this way, an increased demand for pre-warmed coolant can be met, for example in the case of low outside temperatures.

6 Claims, 5 Drawing Sheets

(56) References Cited

U.S. PATENT DOCUMENTS

| | | | | |
|---|---|---|---|---|
| 8,220,421 | B2 * | 7/2012 | Utsuno | 123/41.08 |
| 8,479,691 | B1 * | 7/2013 | Taylor et al. | 123/41.29 |
| 8,555,825 | B2 * | 10/2013 | Lenz et al. | 123/41.79 |
| 8,833,073 | B2 * | 9/2014 | Kuhlbach et al. | 60/599 |
| 2006/0162676 | A1 * | 7/2006 | Pegg et al. | 123/41.1 |
| 2009/0301414 | A1 * | 12/2009 | Netsu | 123/41.72 |
| 2011/0214627 | A1 * | 9/2011 | Nishikawa et al. | 123/41.02 |
| 2012/0090565 | A1 * | 4/2012 | Beyer et al. | 123/41.82 R |

* cited by examiner

LIQUID-COOLED INTERNAL COMBUSTION ENGINE WITH LIQUID-COOLED CYLINDER HEAD AND WITH LIQUID-COOLED CYLINDER BLOCK

CROSS REFERENCE TO RELATED APPLICATIONS

The present application claims priority to German Patent Application No. 102013200297.1, filed on Jan. 11, 2013, the entire contents of which are hereby incorporated by reference for all purposes.

BACKGROUND/SUMMARY

Engines may utilize various cooling jackets in the head and block to provide cooling. However, there may be competing objectives for the cooling system relating to increase engine efficiency and waste heat rejection, improving engine warm-up, maintaining peak temperature control, providing cabin heating, etc.

One approach to balance such objectives includes an engine method, comprising:

pumping coolant from a pump output, in parallel, directly to a block and a head upper coolant jacket;

flowing coolant from the block directly to a head lower coolant jacket;

discharging coolant from the upper and lower jackets only to a control block; and selectively directing cooling from the control block to each of: a cabin heater; radiator bypass line; and the radiator.

For example, it may be possible for a coolant-operated cabin heater to be provided with coolant that has been pre-warmed in the cylinder block. In this way, an increased demand for pre-warmed coolant can be met, for example in the case of low outside temperatures. In this way, all of the coolant conducted through the cylinder head and through the cylinder block can be connected via the heating circuit line to an inlet side of the control block.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
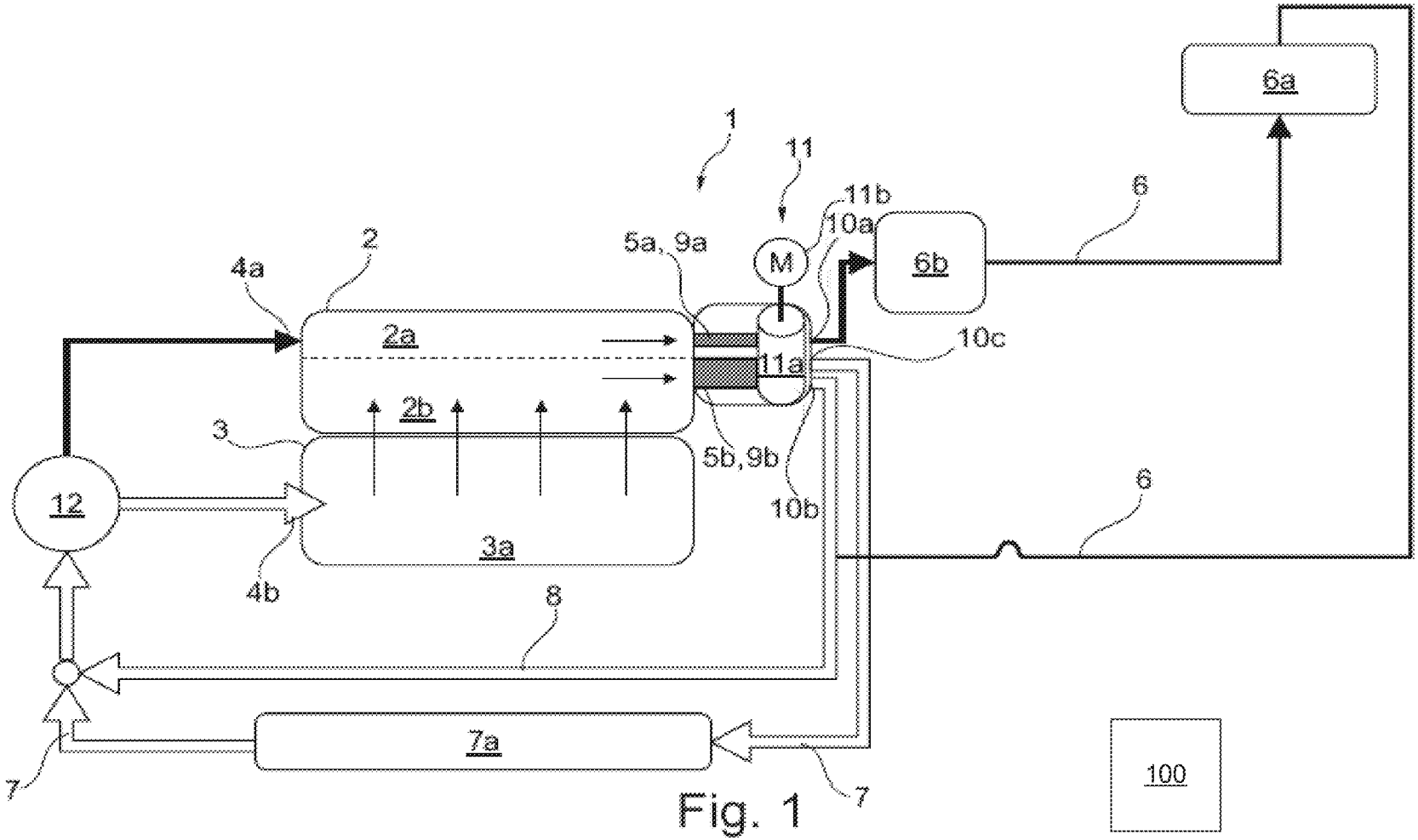
FIG. 1 schematically shows a first embodiment of the internal combustion engine with the setting element in the rest position, FIG. 2 schematically shows the embodiment of the internal combustion engine illustrated in FIG. 1, with the setting element in a first working position, FIG. 3 schematically shows the embodiment of the internal combustion engine illustrated in FIG. 1, with the setting element in a second working position, FIG. 4 schematically shows the embodiment of the internal combustion engine illustrated in FIG. 1, with the setting element in a third working position, and FIG. 5 schematically shows the embodiment of the internal combustion engine illustrated in FIG. 1, with the setting element in a fourth working position.

The present application relates to a liquid-cooled internal combustion engine having at least one cylinder head and one cylinder block, in which the at least one cylinder head is equipped with at least one integrated coolant jacket, said first coolant jacket having, at the inlet side, a first supply opening for the feed of coolant and, at the outlet side, a first discharge opening for the discharge of the coolant, the cylinder block is equipped with at least one integrated coolant jacket, said coolant jacket, which is associated with the block, having, at the inlet side, a second supply opening for the feed of coolant and, at the outlet side, a second discharge opening being provided for the discharge of the coolant, and, to form a coolant circuit, the discharge openings can be connected to the supply openings.

An internal combustion engine of the above-stated type is used for example as a drive for a motor vehicle. Within the context of the present application, the expression "internal combustion engine" encompasses diesel engines and Otto-cycle engines and also hybrid internal combustion engines, that is to say internal combustion engines which can be operated using a hybrid combustion process.

It is basically possible for the cooling arrangement of an internal combustion engine to take the form of an air-type cooling arrangement or a liquid-type cooling arrangement. On account of the higher heat capacity of liquids, it is possible for significantly greater quantities of heat to be dissipated using a liquid-type cooling arrangement than is possible using an air-type cooling arrangement. Therefore, internal combustion engines according to the prior art are ever more frequently being equipped with a liquid-type cooling arrangement, because the thermal loading of the engines is constantly increasing. Another reason for this is that internal combustion engines are increasingly being supercharged and—with the aim of obtaining the densest packaging possible—an ever greater number of components are being integrated into the cylinder head or cylinder block, as a result of which the thermal loading of the engines, that is to say of the internal combustion engines, is increasing. The exhaust manifold is increasingly being integrated into the cylinder head in order to be incorporated into a cooling arrangement provided in the cylinder head and in order that the manifold need not be produced from thermally highly loadable materials, which are expensive.

The formation of a liquid-type cooling arrangement necessitates that the cylinder head be equipped with at least one coolant jacket, that is to say necessitates the provision of coolant ducts which conduct the coolant through the cylinder head. The at least one coolant jacket is fed with coolant at the inlet side via a supply opening, which coolant, after flowing through the cylinder head, exits the coolant jacket at the outlet side via a discharge opening. The heat need not first be conducted to the cylinder head surface in order to be dissipated, as is the case in an air-type cooling arrangement, but rather is discharged to the coolant already in the interior of the cylinder head. Here, the coolant is delivered by means of a pump arranged in the coolant circuit, such that said coolant circulates. The heat which is discharged to the coolant is thereby discharged from the interior of the cylinder head via the discharge opening, and is extracted from the coolant again outside the cylinder head, for example by means of a heat exchanger and/or in some other way.

Like the cylinder head, the cylinder block may also be equipped with one or more coolant jackets. The cylinder head is however the thermally more highly loaded component because, by contrast to the cylinder block, the head is provided with exhaust-gas-conducting lines, and the combustion chamber walls which are integrated in the head are exposed to hot exhaust gas for longer than the cylinder barrels provided in the cylinder block. Furthermore, the cylinder head has a lower component mass than the block.

In one example, the coolant enters the cylinder block coolant jacket from the pump via a first line exterior to the block and head, and coolant enters the head from the pump via a second, different line, also exterior to the block and head. While some coolant flows from the block directly to the lower cylinder head coolant jacket, a separate source of coolant to the cylinder head upper jacket can also be provided via the second, different line. Coolant exits the cylinder block only to the cylinder head lower jacket, and coolant exits the cylinder head upper and lower jackets, optionally in parallel with one another, to the control unit. Coolant may flow from the control unit to only three options, the radiator bypass, and to the cabin heater. The system may be controlled via a microprocessor control system having memory with instructions encoded therein to carry out the various method described herein.

As coolant, use is generally made of a water-glycol mixture provided with additives. In relation to other coolants, water has the advantage that it is non-toxic, readily available and cheap, and furthermore has a very high heat capacity, for which reason water is suitable for the extraction and dissipation of very large amounts of heat, which is basically considered to be advantageous.

To form a coolant circuit, the outlet-side discharge openings at which the coolant exits the coolant jackets can be connected to the inlet-side supply openings which serve for the supply of coolant to the coolant jackets, for which purpose a line or multiple lines may be provided. Said lines need not be lines in the physical sense but rather may also be integrated in portions into the cylinder head, the cylinder block or some other component. An example of such a line is a recirculation line in which a heat exchanger is arranged in order to extract heat from the coolant.

It is not the aim and the purpose of a liquid-type cooling arrangement to extract the greatest possible amount of heat from the internal combustion engine under all operating conditions. In fact, what is sought is demand-dependent control of the liquid-type cooling arrangement, which aside from full load also makes allowance for the operating modes of the internal combustion engine in which it is more advantageous for less heat, or as little heat as possible, to be extracted from the internal combustion engine.

To reduce the friction losses and thus the fuel consumption of an internal combustion engine, fast heating of the engine oil, in particular after a cold start, may be expedient. Fast heating of the engine oil during the warm-up phase of the internal combustion engine ensures a correspondingly fast decrease in the viscosity of the oil and thus a reduction in friction and friction losses, in particular in the bearings which are supplied with oil, for example the bearings of the crankshaft.

Known from the prior art are numerous concepts by means of which the friction losses can be reduced by means of fast heating of the engine oil. The oil may for example be actively heated by means of an external heating device, wherein the heating device however consumes additional fuel, which counteracts a reduction in fuel consumption. Other concepts provide that the engine oil heated during operation be stored in an insulated vessel and utilized upon a restart, wherein the oil heated during operation cannot be held at a high temperature for an unlimited amount of time. In a further concept, in the warm-up phase, a coolant-operated oil cooler is utilized, contrary to its intended purpose, for heating the oil, though this in turn assumes fast heating of the coolant.

Fast heating of the engine oil in order to reduce friction losses may basically also be abetted by means of fast heating of the internal combustion engine itself, which in turn is assisted, that is to say forced, by virtue of as little heat as possible being extracted from the internal combustion engine during the warm-up phase.

In this respect, the warm-up phase of the internal combustion engine after a cold start is an example of an operating mode in which it is advantageous for as little heat as possible, optionally no heat, to be extracted from the internal combustion engine.

Control of the liquid-type cooling arrangement in which the extraction of heat after a cold start is reduced for the purpose of fast heating of the internal combustion engine may be realized through the use of a temperature-dependently self-controlling valve, often also referred to in the prior art as a thermostat valve. A thermostat valve of said type has a temperature-reactive element which is impinged on by coolant, wherein a line which leads through the valve is blocked or opened up—to a greater or lesser extent—as a function of the coolant temperature at the element.

In an internal combustion engine which has both a liquid-cooled cylinder head and also a liquid-cooled cylinder block, like the internal combustion engine which is the subject of the present application, it is advantageous for the coolant throughput through the cylinder head and through the cylinder block to be controllable independently of one another, in particular because the two components are thermally loaded to different degrees and exhibit different warm-up behavior. In this regard, it would be expedient for the coolant flow through the cylinder head and the coolant flow through the cylinder block to be controlled in each case by means of a dedicated thermostat valve with different opening temperatures. At the start of the warm-up phase, the coolant would not flow but rather would remain stationary in the lines and in the coolant jacket of the cylinder head and/or of the cylinder block, whereby the warming of the coolant and the heating of the internal combustion engine would be accelerated, the warming of the engine oil would be expedited and the reduction in friction losses would be assisted.

The use of two or more thermostat valves however increases the costs of the control arrangement, the spatial requirement and the weight. Furthermore, control of the liquid-type cooling arrangement is basically sought with which it is possible not only for the circulating coolant flow rate or the coolant throughput to be reduced or stopped respectively after a cold start, but also for the thermal management of the internal combustion engine in general to be manipulated.

For comfort reasons, it may be advantageous or desirable, in particular after a cold start, for a coolant-operated vehicle interior heater to be supplied, via a heating circuit line, with coolant that has been pre-warmed in the cylinder head and/or cylinder block. Here, there is a conflict of aims, specifically between, on the one hand, the pre-warming of coolant in the cylinder head or cylinder block in order to provide pre-warmed coolant to the heater, and, on the other hand, the stopping or reduction of the coolant throughput through the cylinder head or cylinder block in order that as little heat as possible is extracted from the internal combustion engine during the warm-up phase.

Against the background of that stated above, it is the object of the present application to provide a liquid-cooled internal combustion engine as per the preamble of claim 1, which is optimized with regard to the control of the cooling arrangement, permits a manipulation of the thermal management of the internal combustion engine in general, and in particular satisfies comfort requirements in conjunction with a coolant-operated vehicle interior heater.

Said object is achieved by means of a liquid-cooled internal combustion engine having at least one cylinder head and one cylinder block, in which

- the at least one cylinder head is equipped with at least one integrated coolant jacket, said first coolant jacket having, at the inlet side, a first supply opening for the feed of coolant and, at the outlet side, a first discharge opening for the discharge of the coolant,
- the cylinder block is equipped with at least one integrated coolant jacket, said coolant jacket, which is associated with the block, having, at the inlet side, a second supply opening for the feed of coolant and, at the outlet side, a second discharge opening being provided for the discharge of the coolant, and,
- to form a coolant circuit, the discharge openings can be connected to the supply openings, and wherein

- the first discharge opening can be connected to the first supply opening via a heating circuit line in which there is arranged a coolant-operated vehicle interior heater,
- the second discharge opening can be connected to the second supply opening via a recirculation line in which there is arranged a heat exchanger, and
- the second discharge opening can be connected to the second supply opening via a bypass line.

The internal combustion engine according to an embodiment has a liquid-cooled cylinder head and a liquid-cooled cylinder block and thus has at least two coolant jackets, that is to say at least two coolant circuits, which are or can be separated from one another at least in sections, such that, even in the warm-up phase, at least one coolant circuit is available which supplies pre-warmed coolant to the coolant-operated heater, whereas the coolant throughput through the at least one other coolant circuit is prevented in order that as little heat as possible is extracted from the internal combustion engine.

According to an example embodiment, the first discharge opening of the first coolant jacket integrated in the cylinder head can be connected to the first supply opening via the heating circuit line, such that the coolant-operated heater can, in all operating states, be supplied with coolant that has been pre-warmed in the cylinder head. Thus, a minimum supply of warmed coolant to the heater is ensured.

The approach herein may have numerous advantages. Firstly, the cylinder head is thermally more highly loaded than the cylinder block, such that the head heats up more quickly after a cold start, and consequently the coolant stream conducted through the cylinder head reaches a higher temperature more quickly than a coolant stream conducted through the cylinder block. With regard to fast heating of the passenger compartment after a cold start, this is a noticeable advantage in terms of comfort.

Secondly, the coolant throughput through the cylinder head and through the cylinder block can basically be controlled independently of one another. After a cold start, it would be possible during the warm-up phase for coolant that has been pre-warmed in the cylinder head to be supplied to the heater, whereas the coolant throughput, that is to say coolant stream, through the cylinder block is stopped. The coolant associated with the block does not flow but rather remains stationary in the coolant jacket of the block, whereby said coolant warms up more quickly and the internal combustion engine is heated up in an accelerated manner.

Thus, both objectives are met, that is to say satisfied, in a balanced manner. Firstly, pre-warmed coolant can be supplied to the heater. Secondly, the coolant throughput is at least partially stopped; for example, the coolant stream through the cylinder block is shut off.

The internal combustion engine described in embodiments herein may provide operation that is improved with regard to the control of the cooling arrangement, permits a manipulation of the thermal management of the internal combustion engine in general, and in particular satisfies comfort requirements in conjunction with a coolant-operated vehicle interior heater.

The coolant conducted through the cylinder block can, after exiting the second discharge opening, be recirculated to the inlet side optionally via the recirculation line or via the bypass line, wherein, if desired, heat can be extracted from the coolant in a heat exchanger arranged in the recirculation line.

Further advantageous embodiments according to the subclaims will be described in more detail below. Here, it will in particular be clarified how the coolant circuits or the lines of the circuits are connected to one another and separated from one another, that is to say interconnected, and what effects and actions advantageously result from this.

Embodiments of the liquid-cooled internal combustion engine are advantageous in which the second discharge opening can be connected to the second supply opening via the heating circuit line.

Said embodiment makes it possible for the coolant-operated heater to additionally be provided with coolant that has been pre-warmed in the cylinder block. In this way, an increased demand for pre-warmed coolant can be met, for example in the case of low outside temperatures. In this way, all of the coolant conducted through the cylinder head and through the cylinder block can be connected via the heating circuit line to the inlet side, that is to say the inlet-side supply openings.

Embodiments of the liquid-cooled internal combustion engine are advantageous in which the heating circuit line issues into the bypass line.

The coolant conducted through the heater or through the heating circuit line is, in the present case, recirculated to the inlet side via the bypass line, wherein the heat exchanger arranged in the recirculation line is bypassed. This approach corresponds to the objective of supplying coolant at as high a temperature as possible to the heater, and to the objective of forcing the warming of the coolant in order to accelerate the heating of the internal combustion engine. Extracting heat from the coolant in the heat exchanger would counteract said objectives.

Embodiments of the liquid-cooled internal combustion engine are advantageous in which a coolant-operated cooling device of an exhaust-gas recirculation system is provided in the heating circuit line upstream of the vehicle interior heater.

In this way, heat can be extracted from the hot exhaust gas for recirculation, which heat is additionally supplied to the coolant that has already been pre-warmed in the cylinder head and/or cylinder block. The heating power can be increased in this way. If appropriate, it may be possible in this way to dispense with the additional use of coolant that has been pre-warmed in the cylinder block.

Embodiments of the liquid-cooled internal combustion engine are advantageous in which the second discharge opening, provided at the outlet side, for discharging the coolant is arranged in the cylinder block.

The coolant circuits of the liquid-cooled cylinder head and of the liquid-cooled cylinder block, or the associated coolant jackets, are separated from one another. No exchange of coolant takes place between the cylinder head and the cylinder block.

Embodiments of the liquid-cooled internal combustion engine may however also be advantageous in which the at least one cylinder head is equipped with at least two integrated and mutually separate coolant jackets, wherein the second coolant jacket is connected, in order to be supplied with coolant, to the coolant jacket associated with the block, and the second discharge opening, provided at the outlet side, for the discharge of the coolant is arranged in the cylinder head.

The cylinder head and the cylinder block are, during the course of assembly, connected to one another at their assembly end sides, whereby the cylinders, that is to say the combustion chambers, of the internal combustion engine are formed.

In the present case, a coolant jacket integrated in the cylinder head, said coolant jacket being referred to as second coolant jacket, is supplied with coolant via the block, and for this purpose the second coolant jacket is connected to the coolant jacket associated with the block. Here, the second coolant jacket is advantageously arranged adjacent to the assembly end side in the cylinder head in order to simplify the supply of coolant via the block.

Thus, the cylinder head is traversed partially by a flow of coolant that has already been pre-warmed in the cylinder block, and coolant that is warmed in the cylinder head is not supplied via the heating circuit line to the heater and utilized for warming the passenger compartment, but rather is recirculated to the inlet side via the bypass line or recirculation line.

The second discharge opening provided at the outlet side serves in the present case for the discharge of the coolant out of the coolant jacket associated with the block and out of the second coolant jacket of the cylinder head.

Embodiments of the liquid-cooled internal combustion engine are advantageous in which a pump for delivering coolant is provided upstream of the supply openings. The pump ensures that the coolant circulates in the coolant circuits and heat can be dissipated by means of convection. Embodiments of the internal combustion engine are advantageous in which the pump is variably controllable such that the coolant throughput can be influenced by means of the delivery pressure.

Embodiments of the liquid-cooled internal combustion engine are advantageous in which, at the outlet side, there is provided a coolant control unit which has two inputs and at least three outputs, wherein a first input is connected to the first discharge opening, a second input is connected to the second discharge opening, a first output is connected to the heating circuit line, a second output is connected to the bypass line, and a third output is connected to the recirculation line.

By contrast to the concepts known from the prior art, in which multiple shut-off elements, for example in the form of thermostat valves, are provided at the outlet side, it is the case here that a single control unit is used for the control, according to demand, of the liquid-type cooling arrangement, or for the cooling of the internal combustion engine according to demand.

Controlling the coolant flow both through the cylinder head and also through the cylinder block by means of a single control unit arranged at the outlet side has numerous advantages.

Since a single control unit is used instead of two thermostat valves, there is a resulting reduction in costs, weight and the space requirement of the control arrangement. The number of components is reduced, as a result of which the procurement costs and assembly costs are fundamentally reduced.

In the case of internal combustion engines of the type in question which are equipped with a coolant control unit, embodiments are advantageous in which the coolant control unit comprises a setting element which is adjustable.

Whereas thermostat valves have a characteristic opening temperature, use is made in the present case of a setting element which can be actively adjusted—for example by means of the engine controller—such that it is basically possible to implement characteristic-map-controlled actuation of said setting element, and thus also to realize a coolant temperature adapted to the present load state of the internal combustion engine, for example a higher coolant temperature at relatively low loads than at high loads.

Different coolant temperatures for different load states may be advantageous because the heat transfer in a component is determined not only by the throughput coolant flow rate but rather significantly also by the temperature difference between the component and coolant. A relatively high coolant temperature in part-load operation is thus equivalent to a small temperature difference between the coolant and the cylinder head or cylinder block. The result is reduced heat transfer at low and medium loads. This increases efficiency in part-load operation.

By means of a setting element which is controlled by means of the engine controller, the flows of coolant through the cylinder head and the cylinder block and thus the extracted heat quantities can be adjusted, that is to say controlled, according to demand. Modern internal combustion engines generally have an engine controller, and it is therefore advantageous to utilize said controller for adjusting or controlling the setting element.

The setting element can assume different positions, that is to say switching states. Through actuation, that is to say adjustment of the setting element, the inputs and outputs provided in the coolant control unit can be connected to one another and separated from one another in a variety of ways, and coolant can be conducted selectively through the heating circuit line, the bypass line and/or the recirculation line.

The adjustment of the setting element may be performed as a function of a determined cylinder head temperature, cylinder block temperature and/or vehicle interior temperature. In this way, it is possible for both the cylinder head and also the cylinder block to be temperature-controlled or cooled according to demand and for the vehicle interior to be heated.

Embodiments of the internal combustion engine are advantageous in which the setting element is continuously adjustable, in such a way that, in every working position, the throughflow through the cylinder head and/or through the cylinder block can be adjusted.

It is however basically also possible for the setting element to be of switchable design and then transferred, that is to say switched, in stages from one position into another position, for example from the rest position into a working position or from one working position into another working position.

As has already been stated, it is however particularly advantageous for the setting element to be adjustable within a working position. In this way, it is possible to regulate the coolant flow rate passing through the cylinder head and/or the cylinder block, and thus the heating power that is generated by means of the coolant.

In this context, embodiments of the liquid-cooled internal combustion engine are advantageous in which the setting element, when in a rest position, separates the two inputs from the at least three outputs, such that the coolant circuit both through the cylinder head and also through the cylinder block is shut off.

The rest position is characterized in that both inputs of the control unit are blocked, such that both the coolant stream through the cylinder head and also the coolant stream through the cylinder block are shut off, that is to say prevented.

Such a position of the setting element has proven to be advantageous in particular during the warm-up phase directly after a cold start. After a period in which the vehicle has been at a standstill, that is to say upon a restart of the internal combustion engine, the cooling of the cylinder head and of the cylinder block remains deactivated as a result of the closure of both inputs. The coolant does not flow, but rather is stationary in the coolant jackets of the cylinder head and of the cylinder block. The warming of the coolant and the heating of the internal combustion engine are thus accelerated to the greatest possible extent. Such control forces the warming of the engine oil, as a result of which the friction losses of the internal combustion engine are lowered and the fuel consumption of the internal combustion engine is noticeably reduced.

Furthermore, embodiments of the liquid-cooled internal combustion engine are advantageous in which the setting element, when in a first working position, connects the first input to the first output such that the coolant circuit through the cylinder head is open via the heating circuit line.

The setting element, when in the first working position, opens up the first input and blocks the second input, such that coolant flows through the cylinder head but not though the cylinder block. The first working position is suitable for the warm-up phase of the internal combustion engine, in which the fastest possible heating is sought. In the first working position, coolant flows through the cylinder head and the latter is thus continuously cooled, thereby allowing for the fact that the cylinder head is thermally particularly highly loaded and heats up relatively quickly. The first input can be opened to a greater or lesser extent through adjustment of the setting element within the first working position, as a result of which the throughflow rate and thus the amount of heat extracted from the cylinder head are made adjustable or are adjustable.

In the embodiment in question, in the first working position, the first input is connected to the first output, such that the coolant circuit through the cylinder head is open via the heating circuit line. In this way, it is possible already during the warm-up phase for coolant that has been pre-warmed in the cylinder head to be supplied to the coolant-operated heater, whereby the heating of the passenger compartment is ensured or accelerated after a cold start, which is an advantage in terms of comfort.

As a result of the movement of the setting element into a second working position, the second input of the control unit can additionally be opened up, such that the setting element, when in the second working position, opens up both the first input and also the second input of the control unit, and coolant flows through the cylinder head and the cylinder block. The second input can be opened to a greater or lesser extent through adjustment of the setting element within the second working position, as a result of which the throughflow rate and thus the amount of heat extracted from the cylinder block are made adjustable or are adjustable.

In this connection, embodiments of the liquid-cooled internal combustion engine are advantageous in which the setting element, in a second working position, connects the first input to the first output such that the coolant circuit through the cylinder head is open via the heating circuit line, and connects the second input to the second output such that the coolant circuit through the cylinder block is open via the bypass line. The coolant stream conducted through the cylinder block is in the present case conducted to the inlet side via the bypass line, bypassing the heat exchanger arranged in the recirculation line, that is to say is not cooled as it is recirculated from the outlet side to the inlet side.

Embodiments of the liquid-cooled internal combustion engine may however also be advantageous in which the setting element, in a third working position, connects the first input to the first output such that the coolant circuit through the cylinder head is open via the heating circuit line, and connects the second input to the third output such that the coolant circuit through the cylinder block is open via the recirculation line. The coolant stream conducted through the cylinder block is recirculated to the inlet side via the recirculation line, and in the process is cooled in the heat exchanger. Said cooling may be realized at least partially, because in addition, in the third working position, the second input may be connected to the second output, such that the coolant stream through the cylinder block is recirculated to the inlet side partially via the bypass line and partially via the recirculation line, with the result that only a partial coolant stream is cooled as it is recirculated.

In particular, embodiments of the liquid-cooled internal combustion engine are advantageous in which the setting element, when in a fourth working position, connects the first input and the second input to the first output such that the coolant circuit through the cylinder head and the coolant circuit through the cylinder block are open via the heating circuit line.

In the fourth working position of the setting element, the coolant-operated heater is additionally traversed by a flow of coolant that is pre-warmed in the cylinder block. It is thus possible, if required, for a significantly greater amount of heat to be introduced into the passenger compartment, for example after a cold start in the case of low outside temperatures. Here, all of the coolant conducted through the cylinder head and through the cylinder block is recirculated to the inlet side via the heating circuit line and heater.

Embodiments of the liquid-cooled internal combustion engine are advantageous in which the heat exchanger provided in the recirculation line is equipped with a fan.

Turning now to FIG. 1, it schematically shows a first embodiment of the internal combustion engine 1 with the setting element 11*a* in the rest position. To form a liquid-type cooling arrangement, the internal combustion engine 1 comprises a liquid-cooled cylinder head 2 and a liquid-cooled cylinder block 3. In one example, the engine is a direct fuel injection engine with variable cam timing and an integrated exhaust manifold.

The liquid-cooled cylinder head 2 has two integrated, mutually separate coolant jackets 2*a*, and 2*b*, wherein the first integrated coolant jacket 2*a* has a first supply opening 4*a* at the inlet side for the supply of coolant and has a first discharge opening 5*a* at the outlet side for the discharge coolant. The second integrated coolant jacket 2*b* is supplied with coolant via the cylinder block 3. For this purpose, the second coolant jacket 2*b* of the cylinder head 2 is arranged on the side facing toward the cylinder block 3 and is connected to the coolant jacket 3*a* integrated in the block. The coolant flows from 3*a* to 2*b* as illustrated by arrows. The coolant of the coolant jacket 3*a* associated with the block and the coolant of the second coolant jacket 2*b* integrated in the cylinder head 2 has a second supply opening 4*b* at the inlet side for the supply of coolant and has a second discharge opening 5*b* at the outlet side for the discharge of the coolant. A lower coolant jacket is closer to the block than an upper coolant jacket. In one example, the lower coolant jacket is fully below the upper coolant jacket and between the upper coolant jacket and the block, without any other coolant jackets there between.

To form a coolant circuit, the outlet side discharge openings 5*a* and 5*b* can be connected to the inlet-side supply openings 4*a* and 4*b* via the controller unit 11 in the manner described below. The control unit 11 has two inputs 9*a* and 9*b* and three outputs 10*a*, 10*b*, and 10*c*. The first input 9*a* of the control unit 11 is connected to the first discharge opening 5*a* and the second input 9*b* is connected to the second discharge opening 5*b*. The inputs 9*a* and 9*b* may be connected to the three outputs 10*a*, 10*b*, and 10*c* in the manners described below.

The first output 10*a* is connected to the heating circuit line 6. The heating circuit line 6 comprises a coolant operated vehicle interior heater 6*a* and a coolant operated cooling device 6*b* of an exhaust-gas recirculation system located upstream of 6*a*. The coolant operated cooling device 6*b* additionally heats the coolant before being supplied to 6*a*. The coolant of line 6 issues into the bypass line 8 which connects to a pump 12 for delivering the coolant at the inlet side.

The second output 10*b* is connected to the bypass line 8 and continues in the same manner as described above. The third output 10*c* is connected to the recirculation line 7 and cooled in the heat exchanger 7*a*. The coolant of line 7 connects to a pump 12 for delivering the coolant at the inlet side.

The coolant control unit 11 comprises a setting element 11*a* which can assume different positions whereby lines 6, 7, and 8 and the coolant jackets 2*a*, 2*b*, and 3*a* of the coolant circuit can be connected to one another in different ways. The setting element 11*a* may make use of a drum which is rotatable about its longitudinal axis and which is actuated by means of an electric motor as a drive 11*b*. A control system 100 to control an electromechanical actuator via reading information from vehicle sensors, the actuator controlled responsive to code stored in non-transitory memory.

Illustrated in FIG. 1, the rest position, the setting element 11*a* separated the two inputs, 9*a* and 9*b*, from the three outputs 10*a*, 10*b*, and 10*c* such that the coolant stream both through the cylinder head 2 and also through the cylinder block 3 is shut off.

Figure 2:
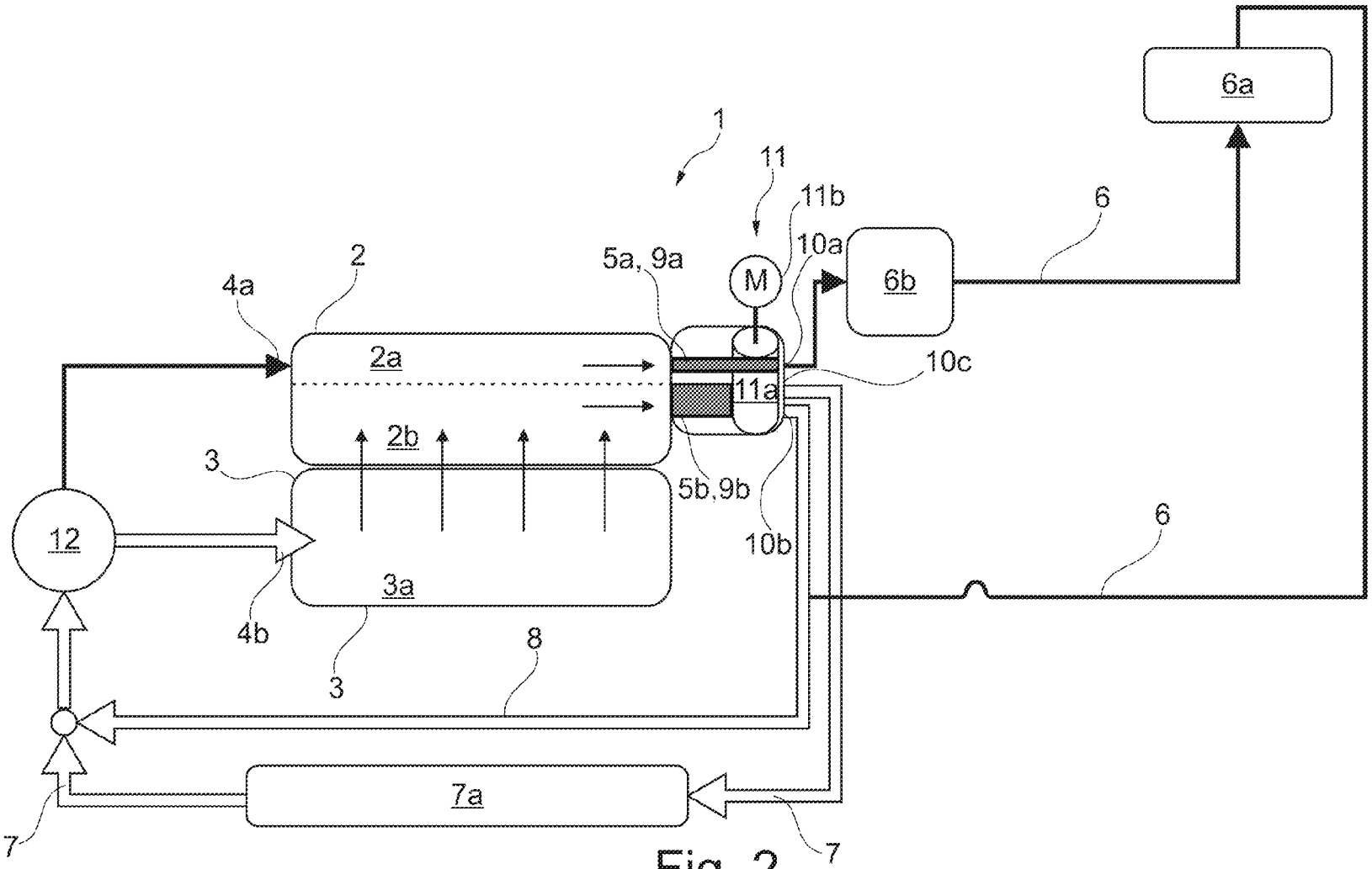

Now turning to FIG. 2, the setting element 11*a* being transferred into the first working position by rotation of 11*b*, the first input 9*a* is connected to the first output 10*a* such that coolant may pass from the first coolant jacket 2*a* through the heating circuit line 6 and through the bypass line 8 to the pump 12 for delivery to the inlet side supply. The setting element in the first working position separated input 9*b* from all outputs 10*a*, 10*b*, and 10*c* such that the coolant stream through the block 3 and second coolant jacket 2*b* is shut off. It should be noted that in FIGS. 1-4, the connections shown by the shading of the valve indicate where fluid flows. In one example, the shading shows only where fluid flows (e.g., the connection through the valve are only those shown, and not others), such that there is no fluid flowing elsewhere through the valve other than as indicated in figures. For example, in FIG. 1, there is no fluid flowing (and no connection through the valve to line 7. Likewise, in FIG. 2, there is no flow to each of lines 7 and 8. While all of the non-connections are not repeated here in the text to avoid unnecessary wording, the disclosure from the figures makes clear that this description positively sets forth disclosure of where the flow is not flowing, and further that in one example, the disclosed flow and connections are the only such flow and connections through the valve.

Figure 3:
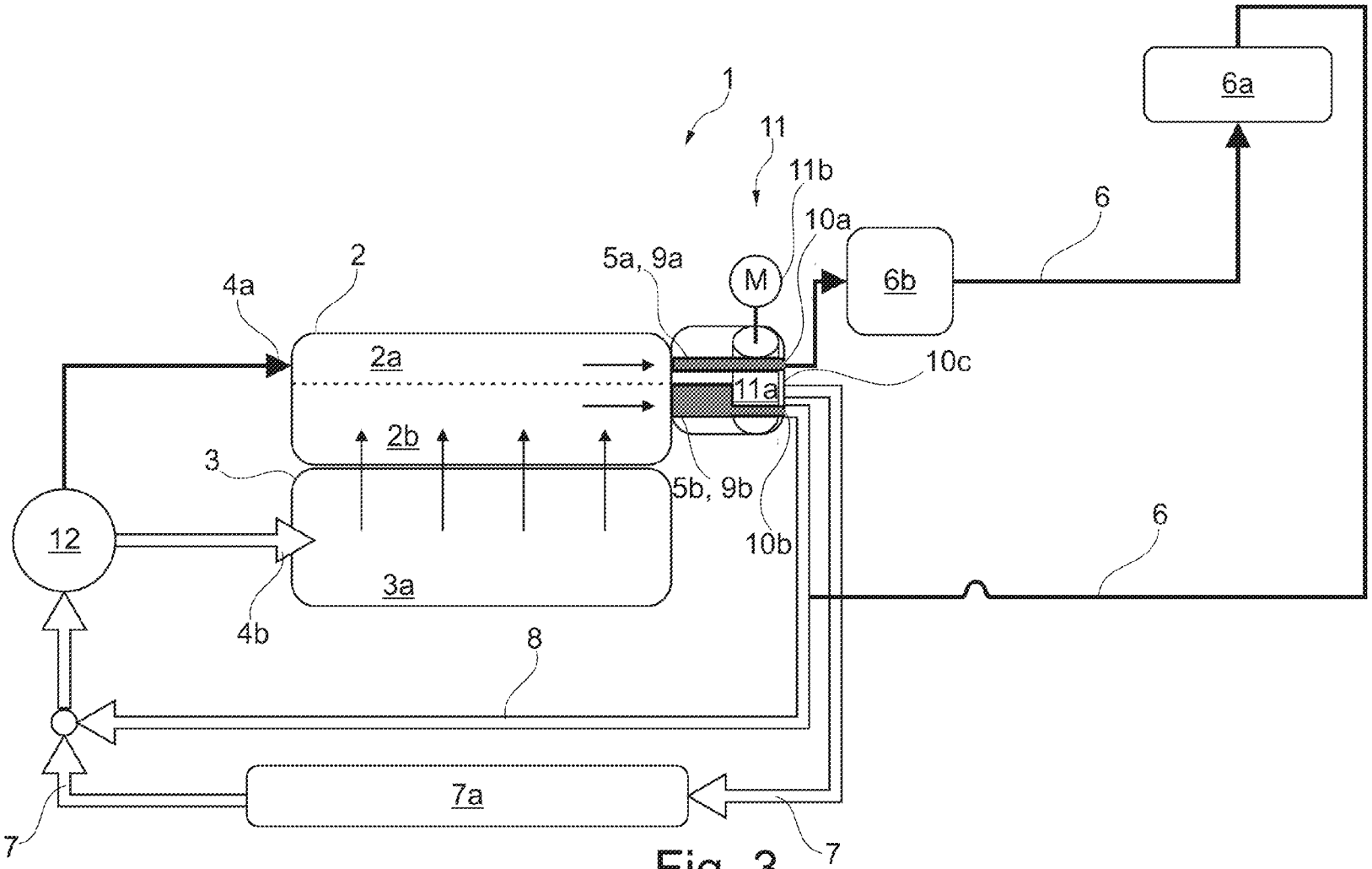

Now turning to FIG. 3, the rotation of the drum moves the setting element 11*a* into the second working position. The second working position has the first input 9*a* being connected to the first output 10*a* as described in FIG. 2 and in addition the second input 9*b* is connected to the second output 10*b*. The coolant stream through the coolant jacket 3*a* and coolant jacket 2*b* are permitted to flow to the inlet side supply openings via the bypass line 8. The setting element in the second working position separated the second input 9*b* from the third output 10*c* such that the coolant stream through the recirculation line 7 is shut off.

Figure 4:
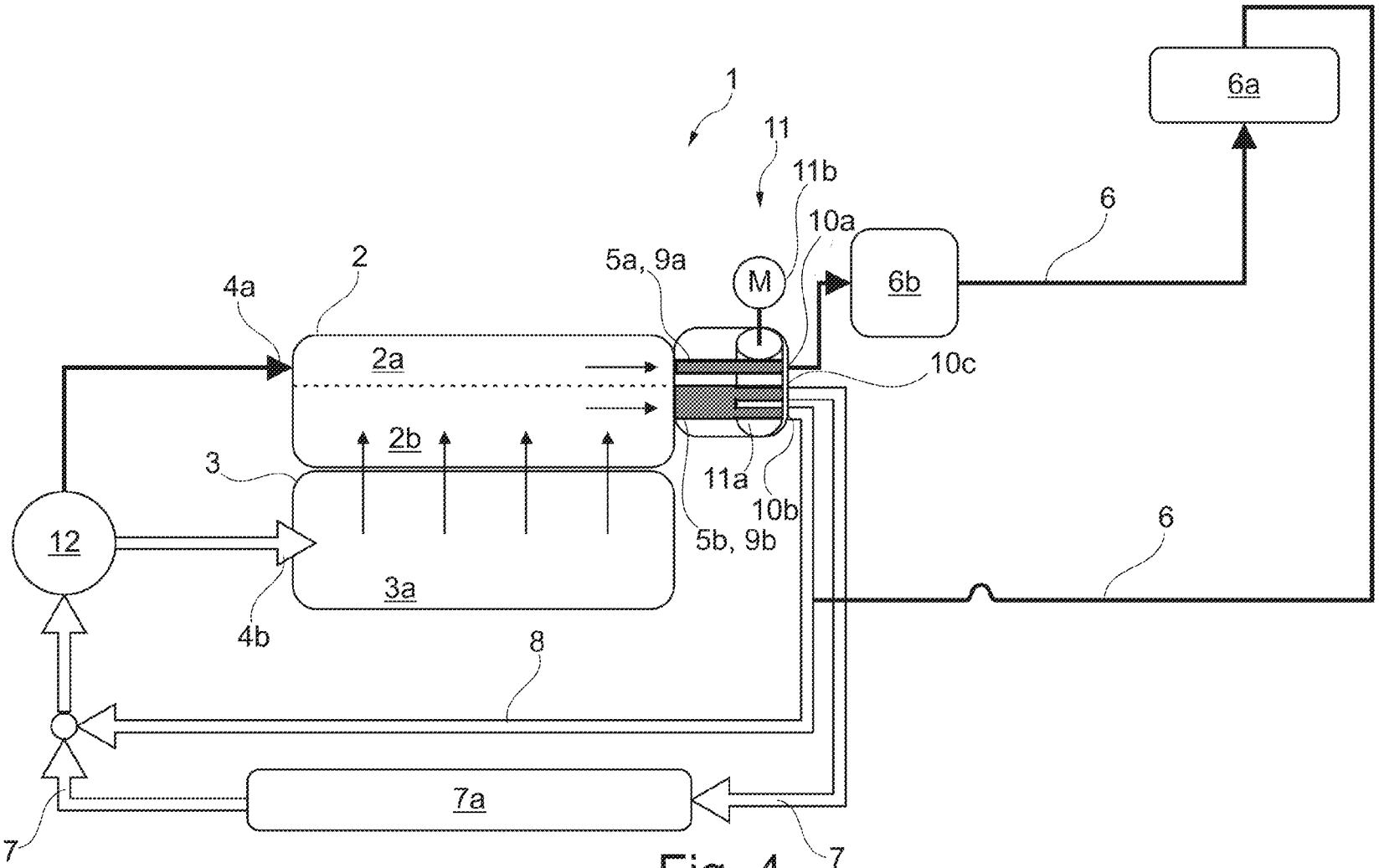

Now turning to FIG. 4, the rotation of the drum moves the setting element 11*a* into the third working position. The third working position has the first input 9*a* connected to the first output 10*a* as described in FIG. 2 and has the second input 9*b* connected to the second output 10*b* as described in FIG. 3. In addition, the third working position has the second input 9*b* connected to the third output 10*c*. The coolant stream through the coolant jacket 3*a* and coolant jacket 2*b* are permitted to flow to the inlet side supply openings via the recirculation line 7 passing through the heat exchanger 7*a*.

Figure 5:
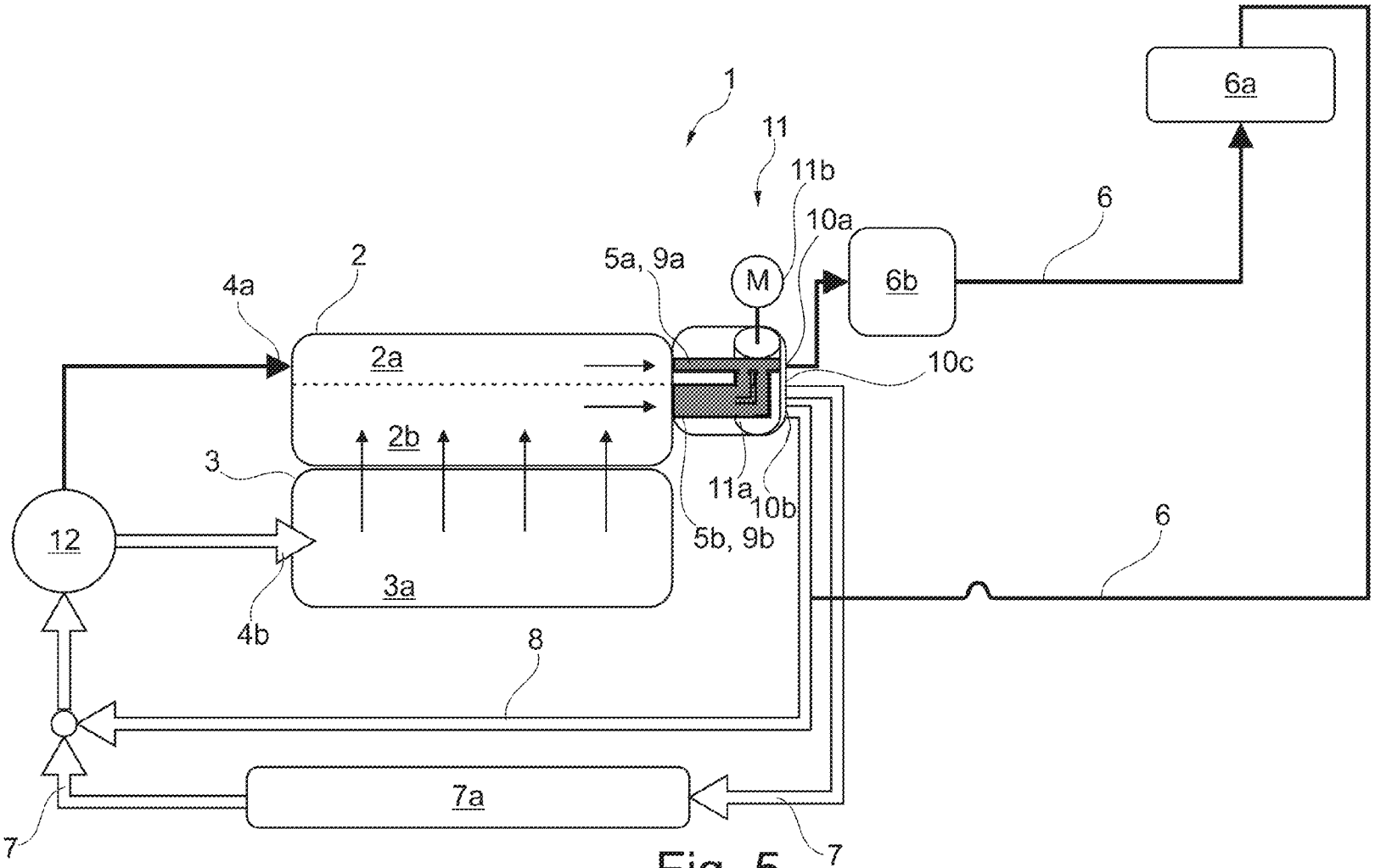

Now turning to FIG. 5, further rotation of the drum moves the setting element 11*a* into the fourth working position. The fourth working position has the first input 9*a* and second input 9*b* connected to the first output 10*a* such that the coolant may pass from the first coolant jacket 2*a*, second coolant jacket 2*b*, and third coolant jacket 3*a* through the heating circuit line 6 and the bypass line 8. The fourth working position increases the heating power of the heater 6*a* when required. The fourth working position separates the second input 9*b* from the second output 10*b* and third output 10*c* such that the coolant stream is shut off.

SUMMARY OF REFERENCE SYMBOLS

1 Liquid-cooled internal combustion engine
2 Cylinder head
2*a* First coolant jacket of the cylinder head
2*b* Second coolant jacket of the cylinder head
3 Cylinder block
3*a* Coolant jacket associated with block
4*a* First supply opening
4*b* Second supply opening
5*a* First discharge opening
5*b* Second discharge opening
6 Heating circuit line
6*a* Coolant-operated vehicle interior heater, heater
6*b* Coolant-operated cooling device
7 Recirculation line
7*a* Heat exchanger
8 Bypass line
9*a* First input
9*b* Second input
10*a* First output
10*b* Second output
10*c* Third output
11 Coolant control unit, control unit
11*a* Setting element
11*b* Drive
12 Pump As will be appreciated by one of ordinary skill in the art, methods described herein may represent one or more of any number of processing strategies such as event-driven, interrupt-driven, multi-tasking, multi-threading, and the like. As such, various steps or functions illustrated may be performed in the sequence illustrated, in parallel, or in some cases omitted. Likewise, the order of processing is not necessarily required to achieve the objects, features, and advantages described herein, but is provided for ease of illustration and description. Although not explicitly illustrated, one of ordinary skill in the art will recognize that one or more of the illustrated steps or functions may be repeatedly performed depending on the particular strategy being used. Further, the described actions, operations, methods, and/or functions may graphically represent code to be programmed into non-transitory memory of computer readable storage medium in an engine control system having a processor, sensors coupled to the engine, and actuators such as the motor and valve actuators described herein.

This concludes the description. The reading of it by those skilled in the art would bring to mind many alterations and modifications without departing from the spirit and the scope of the description. For example, I3, I4, I5, V6, V8, V10, and V12 engines operating in natural gas, gasoline, diesel, or alternative fuel configurations could use the present description to advantage.

The invention claimed is:

1. An engine method, comprising:

pumping coolant from a pump output, in parallel, directly to a block and a head upper coolant jacket;

flowing coolant from the block directly to a head lower coolant jacket;

discharging coolant from the upper and lower jackets only to a control block;

flowing the coolant from the lower coolant jacket to a cabin heater, a radiator bypass, and a radiator from the control block;

flowing the coolant from the upper coolant jacket to only the cabin heater from the control block; and flowing coolant from the lower coolant jacket and the upper coolant jacket to the cabin heater simultaneously.

2. The method of claim 1 wherein the engine is a direct injection engine with an integrated exhaust manifold.

3. The method of claim 2 wherein the engine includes an exhaust gas recirculation system.

4. An engine method, comprising:

pumping coolant from a pump output, in parallel, directly to an engine cylinder block and a cylinder head upper coolant jacket;

flowing coolant from the cylinder block directly to a cylinder head lower coolant jacket;

discharging coolant from the upper and lower jackets only to a control unit;

flowing the coolant from the upper coolant jacket to only a cabin heater from the control unit; and adjusting a valve in the control unit via an electromechanical actuator controlled by a control system reading information from vehicle sensors, the actuator controlled responsive to code stored in non-transitory memory.

5. The method of claim 4 further comprising a coolant-operated vehicle interior heater upstream of a coolant-operated cooling device in a coolant line leading from the control unit and returning to a radiator bypass.

6. The method of claim 1, further comprising adjusting a valve in the control block via an electromechanical actuator controlled by a control system reading information from vehicle sensors, the actuator controlled responsive to code stored in non-transitory memory.

* * * * *